United States Patent [19]

Merryman

[11] Patent Number: 4,637,892

[45] Date of Patent: Jan. 20, 1987

[54] CLEANING SOLUTION

[76] Inventor: Ora S. Merryman, 1711 Lewis, Las Vegas, Nev. 89101

[21] Appl. No.: 826,011

[22] Filed: Feb. 4, 1986

[51] Int. Cl.[4] ..... C11D 3/42

[52] U.S. Cl. ..... 252/139; 252/114; 252/135; 252/162; 252/170; 252/173; 252/531; 252/DIG. 14; 134/39; 134/40; 134/42

[58] Field of Search ..... 252/114, 135, 139, 162, 252/170, 173, 531, DIG. 14; 134/39, 40, 42

[56] References Cited

U.S. PATENT DOCUMENTS 4,152,305 5/1979 Berghausen, III ..... 252/139
4,219,333 8/1980 Harris ..... 252/139
4,414,128 11/1983 Goffinet ..... 252/170
4,530,781 6/1985 Gipp ..... 252/170

*Primary Examiner*—Paul Lieberman
*Assistant Examiner*—Hoa Van Le
*Attorney, Agent, or Firm*—Poms, Smith, Lande & Rose

[57] ABSTRACT

An all-purpose aqueous cleaning solution and deodorizing stain remover for use in cleaning all manner of stains from natural and synthetic materials, surfaces and fabrics is formed of a preferred concentration of 6% by volume aromatic petroleum solvent, 2% by volume aqueous wetting agent, and 6% by volume hydrated sodium borate. The cleaning solution will completely remove and deodorize all manner of stains including physiological fluids without the use of enzymes or strong cleaning agents and is safe for use on all fabrics and materials.

10 Claims, No Drawings

CLEANING SOLUTION

FIELD OF THE INVENTION

The present invention relates in a broad aspect to an all-purpose cleaning solution composition. More particularly, the present invention is directed to an improved, all-purpose, aqueous cleaning solution and deodorizing stain remover for use in cleaning natural and synthetic materials, surfaces and fabrics.

BACKGROUND OF THE INVENTION

A wide variety of cleaning solutions are presently known in the art. Typically, a particular cleaning solution is useful for only a limited application. For example, a number of spray cleaners are currently available on the market for cleaning hard surfaces such as counter tops and household appliances. Similarly, other cleaning solutions are commercially available for cleaning textiles and carpets. Additionally, specialized cleaning solutions are also available for removing or lifting spots and stains from textiles. Moreover, various cleaning processes such as dry cleaning, steam cleaning, and shampooing utilize different types of cleaning solutions. Dry cleaning processes utilize volatile petroleum based solvents such as carbon tetrachloride; whereas steam cleaning and shampooing processes may utilize any of a number of soaps and detergents dispursed in high temperature steam or aqueous solutions.

In addition to dirt particles, typical stains are formed of organic compounds, greases, oils, foods, physiological fluids, cosmetics and paints which adhere to the fibers of fabrics and the surfaces of other materials. These compounds work their way into and pentrate the fibers of fabrics and carpets and therefore are particularly difficult to remove from textiles. Adding to this difficulty is the fact that various types of fibers are used in different textiles and carpets. Wools and cottons are common, naturally occurring materials whereas polyamide fibers such as nylon and polyester fibers are common synthetic materials. In general, most cleaning solutions are formulated to solublize the oils, greases, and other organic compounds to which dirt and other particulates adhere causing stains. By solubilizing these sticky or tacky organic compounds it is possible to suspend the components of the stain in solution which can be removed from the fabric or material being cleaned.

Somes types of fibers are more absorbent to one particular type of soil than another. For example, a number of synthetic fibers are resistant to water based stains such as foods, yet are particularly susceptible to chemical based stains. Adding to the difficulty of cleaning this diversity of materials is the fact that a number of synthetic fibers are damaged by cleaning solvents. Additionally, when cleaning carpets the large amounts of water typically necessary to rinse most cleaning solutions often saturate the carpet and the underlying pad. As a result, long periods of time may be required for drying.

Accordingly, it is a principal object of the present invention to provide an all-purpose cleaning solution having wide applicability that will completely remove stains from both natural and synthetic materials, surfaces and fibers.

It is a further object of the present invention to provide a cleaning solution which will completely remove stains without the use of enzymes or harsh cleaning agents and without harming the material or fabric being cleaned and without demaging the colors of such materials or fabrics.

An additional object of the present invention is to provide a cleaning solution which also will deodorize textiles and fabrics as it cleans.

A still further object of the present invention is to provide a cleaning solution having broad application and suitable for use as a steam cleaning solution, rug shampoo, fabric and textile cleaner, spot remover, deodorizer, and surface cleaner.

SUMMARY OF THE INVENTION

These and other objects are achieved by the novel all-purpose aqueous cleaning solution of the present invention which safely cleans and deodorizes both natural and synthetic materials, surfaces and fabrics. The cleaning solution of the present invention can be prepared as a concentrate or in solutions of various dilution to function in a wide variety of cleaning processes and operations. Moreover, the cleaning solution of the present invention is safe for all textiles and fabrics and will not remove colors or dyes.

Of primary importance and unlike any cleaning solution known to date, the instant cleaning solution of the present invention will completely remove and deodorize animal urine stains from fabric or carpet regardless of the length of time the material has been stained. Additionally, the cleaning solution of the present invention will also remove paint, fingernail polish, make-up, inks, mildew and other difficult stains in addition to the more commonly cleaned stains discussed above.

This novel cleaning action is accomplished by means of an aqueous cleaning solution comprising from 2 to 25 percent by volume aromatic petroleum solvents, from 2 to 25 percent by volume aqueous wetting agent, and from 2 to 25 percent by volume hydrated sodium borate. The water content of this novel formulation can be varied from 25 to 94 percent to produce cleaning solutions ranging from concentrated stain removers to more dilute shampoos and steam cleaning solution.

The solution is applied directly to the stain and when applied to fabrics is worked into the material where it penetrates the fibers. Immediately upon application, the mixture causes a breakdown of the stain and lifts the stain into solution for subsequent removal by absorbent wiping or vacuuming.

DETAILED DESCRIPTION

In a broad aspect, the cleaning solution of the present invention is formed of an aqueous solution comprising aromatic petroleum solvent, aqueous wetting agent, and hydrated sodium borate (commonly known as borax). These solution components can be present in roughly equal parts ranging from 2–25 percent by volume. However, it has been found that the concentration of aqueous wetting agent is preferably significant less than that of the aromatic petroleum solvent or the hydrated sodium borate. An exemplary solution in accordance with the present invention comprises from 2–20 percent by volume aromatic petroleum solvent, from 2–10 percent aqueous wetting agent, and from 2–20 percent hydrated sodium borate. The remaining 50–94 percent of the solution being formed of water. This solution composition produces the same cleaning, stain removing and deodorizing power at a lower expense due to the lesser concentration of aqueous wetting agent. What is more, it has been found that excessive concentrations of aqueous wetting agent will produce a soaplike residue that must be rinsed from the material or fabric being cleaned.

A preferred exemplary embodiment of the aqueous cleaning solution in accordance with the present invention comprises 6 percent by volume aromatic petroleum solvent, 2 percent by volume aqueous wetting agent, 6 percent by volume hydrated sodium borate, and 86 percent by volume water. This solution composition causes a breakdown in fabric and material stains unlike any other cleaning solution. This preferred aqueous cleaning solution composition is readily absorbed by fabric or carpet fibers and immediately begins solubilizing the components forming the stain. Subsequently, minimal amount of mechanical washing action, such as that provided by sponging or carpet shampooers, completely breaks up stains and places the stain materials into solution. The cleaning solution then is removed readily from the material or fabric being cleaned by absorbtion or vacuuming.

Unlike prior art cleaning solutions that fail to pick up and retain stain soil, the cleaning composition of the present invention loosens and disperses the stain soil into solution and completely removes it from the material, surface or fabric being cleaned. Thus, the stain components are not redeposited on the material or surface being cleaned. Additionally, the preferred composition of the cleaning solution of the present invention does not leave detergent or soap residue in materials such as fabric or carpet. As a result, after cleaning the cleaned fabric or carpet does not become tacky from detergent film and hence does not attract soil. Moreover, the cleaning solution of the present invention will remove any stain (other than dye) yet is gentle enough to use on fine fabrics such as silk, velvet or modern synthetic materials.

The novelty of the cleaning solution of the present invention is further exemplified by its ability to completely remove and deodorize physiological fluid stains from fabrics and carpet. Regardless of the length of time for which fabric or carpet has been stained, physiological fluid stains such as blood or urine are completely removed by the cleaning solution of the present invention. Moreover, these previously uncleanable stains are completely cleaned without affecting the color of the material being cleaned. It is believed that this novel cleaning capability is provided not only by the constituents of the cleaning solution of the present invention but also by the novel component ratio. This novel composition readily penetrates the fibers of the woven fabric or carpet, breaking up the organic components of the stains and lifting them in solution to the top of the fabric where they can be wiped away or vacuumed from the material.

Suitable aromatic petroleum solvents for use in the aqueous cleaning solution of the present invention include aromatic distillates obtained from the naphtha cut of refined petroleum products. Preferred aromatic petroleum distillates will be selected from the alkyl derivitaves of benzene, naphthalene, anthracene, or phenanthrene and may include combinations of such compounds. Preferably, the aromatic petroleum solvents will have a boiling point ranging from approximately 80° C. to approximately 250° C. It is believed that these aromatic petroleum solvents aid in dissolving organic soils and placing them into solution. Additionally, these solvents also enhance the drying of fabrics and materials being cleaned.

A preferred aqueous wetting agent for practicing the present invention is dodecyl sodium sulfate. This mild soap has the desired properties of dispursing the dissolved stain components without hurting colors. Additionally, at the preferred concentration this aqueous wetting agent does not produce undesireable foaming action and can be removed completely from fabrics or materials without subsequent rinsing.

The hydrated sodium borate is believed to act as a water softener, flux, and mild cleansing agent and also functions to deodorize the stained material or fabric being cleaned.

To produce the cleaning solution of the present invention the desired concentrations of the constituent components are placed in a mixing vessel and put into solution through the addition of hot water with stirring. It is preferred that only a portion of the desired final water concentration be added for this purpose. The remaining amount of water is added subsequently to produce a cleaning solution of the desired concentration. The preferred 6 percent aromatic petroleum solvent, 2 percent aqueous wetting agent, and 6 percent hydrated sodium borate solution functions directly as an all-purpose spot remover and cleaning solution. This preferred composition may also be added to carpet shampoos or steam cleaning equipment to produce enhanced fabric or carpet cleaning. Conversely, it is also possible to produce the preferred 3 to 1 to 3 aromatic petroleum solvent to aqueous wetting agent to hydrated sodium borate composition in a concentrated form which then may be diluted to a final desired concentration.

The following examples are included to further illustrate the present invention. They are not intended to restrict the scope of the invention in any manner.

EXAMPLE I

An aqueous all-purpose cleaning solution and deodorizing stain remover was prepared by mixing the following ingredients:

| Component | % Volume |
|---|---|
| Aromatic petroleum solvent | 6.0 |
| Dodecyl Sodium Sulfate | 2.0 |
| Hydrated Sodium Borate | 6.0 |

The above component mix was dissolved in hot distilled water and stirred. The aqueous cleaning solution was directly applied to a carpet made from a blend of wool and nylon which had been soiled with canine urine and dirt. The cleaning solution rapidly penetrated into the carpet and was worked into the fibers with a damp sponge. The stain was immediately disspitated into the solution which was subsequently removed by blotting with a dry cloth. The carpet dried rapidly with no remaining traces of the stain. No cleaning residue or rings were observed.

EXAMPLE II

The above aqueous cleaning solution was sprayed directly onto drapes made from a blend of synthetic fibers which had been stained with canine urine. The cleaning solution rapidly penetrated into the material of the drapes. The stained area was worked with a damp sponge and then blotted with a dry towel. The urine stain was observed to rapidly dissipate upon application of the solution and was completely removed upon blotting. The drapes dried rapidly with no traces of the original stain. A slight water mark was observed around the spot cleaned area. This water mark was removed upon subsequent dry cleaning. No trace of the original animal urine stain or water mark was visible in the drapes after dry cleaning.

EXAMPLE III

The above aqueous cleaning solution was diluted by adding 2.5 cups of the cleaning solution to 2 gallons of carpet shampoo solution. The resulting solution was loaded into a carpet shampooer and utilized to shampoo a carpet made from a blend of wool and nylon which had been soiled with dirt, oil, and make-up. The solution was readily absorbed by the carpet which was brushed with the fabric disc of the shampooer and subsequently vacuumed with a wet-dry vacuum. The carpet dried rapidly and no traces of the various stains were visible.

EXAMPLE IV

The above aqueous cleaning solution was directly applied onto the carpet made from a blend of wool and nylon which had been stained with household interior paint. The solution rapidly penetrated into the carpet and was worked with a damp sponge. The paint stain was observed to break up and loosen from the carpet fibers and was removed with a dry towel. The carpet dried rapidly and no traces of the paint stain were visible.

In the foregoing description of the present invention, preferred embodiments of the aqueous cleaning solution of the invention have been disclosed. It is to be understood that other solution compositions are contemplated as being within the scope of the present invention. Thus, by way of example and not of limitation, the cleaning solution of the present invention can be formed as a concentrate having little or no water which then may be diluted to a desired aqueous concentration. Accordingly, the invention is not limited to the particular embodiments as disclosed and described in detail herein.

I claim:

1. An improved, all purpose aqueous cleaning solution and deodorizing stain remover for use in cleaning natural and synthetic materials and fabrics, said solution comprising:

from 2 to 25% aromatic petroleum solvent;
from 2 to 25% aqueous wetting agent;
from 2 to 25% hydrated sodium borate; and
from 25 to 94% water.

2. The cleaning solution of claim 1 wherein said aromatic petroleum solvent is selected from the group consisting of one or more alkyl devivatives of benzene, naphthalene, anthracene, or phenanthrene.

3. The cleaning solution of claim 1 wherein said aqueous wetting agent is dodecyl sodium sulfate.

4. The cleaning solution of claim 1 wherein said aromatic petroleum solvent and said hydrated sodium borate are present in equal amounts.

5. An improved, all purpose aqueous cleaning solution and deodorizing stain remover for use in cleaning natural and synthetic materials and fabrics, said solution comprising:

from 2 to 20% aromatic petroleum solvent;
from 2 to 10% aqueous wetting agent;
from 2 to 20% hydrated sodium borate; and
from 50 to 94% water.

6. The cleaning solution of claim 5 wherein said aromatic petroleum solvent is selected from the group consisting of one or more alkyl derivatives of benzene, naphthalene, anthracene, or phenanthrene.

7. The cleaning solution of claim 5 wherein said aqueous wetting agent is dodecyl sodium sulfate.

8. An improved, all purpose aqueous cleaning solution and deodorizing stain remover for use in cleaning natural and synthetic materials, surfaces and fabrics, said solution comprising:

6% aromatic petroleum solvent;
2% aqueous wetting agent;
6% hydrated sodium borate; and
86% water.

9. The cleaning solution of claim 8 wherein said aromatic petroleum solvent is selected from the group consisting of one or more alkyl derivatives of benzene, naphthalene, anthracene, or phenanthrene.

10. The cleaning solution of claim 8 wherein said aqueous wetting agent is dodecyl sodium sulfate.

* * * * *